US009488424B1

(12) United States Patent
Kincel

(10) Patent No.: US 9,488,424 B1
(45) Date of Patent: Nov. 8, 2016

(54) CHARGING HANDLE WITH COG AND SPRING

(71) Applicant: Bravo Company USA, Inc., Hartland, WI (US)

(72) Inventor: Eric Stephen Kincel, Las Vegas, NV (US)

(73) Assignee: BRAVO COMPANY MFG, INC., Hartland, WI (US)

( * ) Notice: Subject to any disclaimer, the term of this patent is extended or adjusted under 35 U.S.C. 154(b) by 0 days.

(21) Appl. No.: 14/732,339

(22) Filed: Jun. 5, 2015

(51) Int. Cl.
*F41A 3/72* (2006.01)

(52) U.S. Cl.
CPC ..... *F41A 3/72* (2013.01)

(58) Field of Classification Search
CPC ..... F41A 3/72
See application file for complete search history.

(56) References Cited

U.S. PATENT DOCUMENTS 2,181,131 A * 11/1939 Johnson, Jr. ..... F41A 3/72 42/16
2,353,283 A * 7/1944 Woodhull ..... F41A 3/72 42/111
3,377,730 A * 4/1968 Lewis ..... F41A 3/18 42/16
5,727,422 A * 3/1998 Kammerer ..... F16H 19/04 74/422
7,240,600 B1 * 7/2007 Bordson ..... F41A 3/72 42/69.01
7,832,322 B1 * 11/2010 Hoel ..... F41A 3/20 42/16
8,104,393 B2 * 1/2012 Kincel ..... F41A 3/72 42/16
8,261,649 B2 * 9/2012 Fitzpatrick ..... F41A 19/47 89/1.4
8,336,436 B2 12/2012 Kincel
8,336,463 B2 * 12/2012 Smith ..... B61B 7/00 104/112
8,356,537 B2 * 1/2013 Kincel ..... F41A 3/72 42/16
8,567,301 B1 * 10/2013 Sharron ..... F41A 3/72 89/1.4
8,960,066 B2 * 2/2015 Gomez ..... F41A 3/72 42/43
8,967,019 B2 * 3/2015 O'Keefe ..... B60K 37/06 74/533
9,175,913 B2 * 11/2015 Cupps ..... F41A 3/72
9,222,783 B2 * 12/2015 Kansal ..... G01C 21/20
2002/0104396 A1 * 8/2002 Megason ..... F16H 51/00 74/109
2011/0005372 A1 * 1/2011 Kincel ..... F41A 3/72 89/1.4
2011/0214558 A1 * 9/2011 Kincel ..... F41A 9/00 89/1.4
2011/0265636 A1 * 11/2011 Overstreet ..... F41A 3/72 89/1.4
2012/0291612 A1 * 11/2012 Kincel ..... F41A 35/06 89/1.4
2013/0092014 A1 * 4/2013 Kincel ..... F41A 3/72 89/1.4
2013/0192113 A1 * 8/2013 Melville ..... F41A 7/00 89/1.4
2014/0060293 A1 * 3/2014 Gomez ..... F41A 3/72 89/1.4
2016/0061542 A1 * 3/2016 Daley, Jr. ..... F41A 3/72 89/1.4

* cited by examiner

*Primary Examiner* — Troy Chambers
*Assistant Examiner* — Bridget Cochran
(74) *Attorney, Agent, or Firm* — Howard & Howard Attorneys PLLC

(57) ABSTRACT

A firearm comprising an upper receiver and a charging handle is disclosed. A charging handle is coupled to the upper receiver and comprises a handle assembly rotationally coupled to a main body about a first and a second pivot point. The handle assembly includes a first handle having an edge nearest the main body and a latch extending from the first handle parallel to the main body for interfacing with the upper receiver in a first position, a second handle having an edge nearest the main body, and a plunger interfacing with the edge of the first handle and the edge of the second handle, and a spring, such that when force is applied to either handle, the plunger is pushed into the main body and energy is transferred to the handles, moving the latch into a second position.

10 Claims, 13 Drawing Sheets

CHARGING HANDLE WITH COG AND SPRING

TECHNICAL FIELD

The subject invention generally concerns firearm equipment. More particularly, the present invention relates to a charging handle for a firearm utilizing a cog and a spring.

BACKGROUND OF THE INVENTION

A firearm's charging handle (otherwise known in the art as a "cocking handle" or a "bolt handle") is a device used to cock the hammer, which allows the operator to engage the bolt assembly of a firearm. Charging handles are typically used in rifles and similar firearms, such as the M-16 rifle, the AR-15 rifle, the M-4 carbine, and the Short Barreled Rifle (SBR). Operation of the charging handle facilitates many actions, including, for example, loading a preliminary cartridge, ejecting a spent shell casing or unfired cartridge, clearing an obstruction in the chamber of the rifle, and verifying that the chamber is empty. Typically, a charging handle is T-shaped with a long, slim body and a shorter horizontal crossbar at one end. The charging handle is mounted parallel to the bolt assembly.

The user of a firearm manually operates the charging handle. The user hooks the forefinger of one hand over one end of the crossbar and the middle finger of the same hand over the second end of the crossbar. The user pulls the crossbar rearward, which results in the bolt assembly being moved to the rear. The typical charging handle includes a spring-biased, rotating latch with a hook that engages the firearm receiver when the charging handle is in a forward position. The latch is attached to the charging handle with a pin. When the user pulls the crossbar rearward, the latch disengages from the receiver and allows the charging handle to be pulled rearward.

There are several disadvantages associated with the traditional charging handle design, which requires two fingers to operate. The use of two fingers to operate the charging handle requires that the user move the firearm off target. An improved prior art design includes using paddles on the latch such that the user can press either paddle with one finger or either hand, which releases the latch and moves the charging handle backward. This makes the latch easier to reach and allows the firearm to stay on target. However, this design causes stress on the pin holding the latch to the charging handle.

An improved design includes a lever system that uses one male lever and one female lever that interlock inside the body of the charging handle. An example is described in U.S. Pat. No. 7,240,600, entitled "Rifle Charging Handle with Ambidextrous Latch" issued to Bordson on Jul. 10, 2007, which is incorporated herein by reference. Similarly, an alternate improved design includes an internal lever system with two cam-style, interfacing levers. Examples of such designs are described in U.S. Pat. No. 8,336,436, entitled "Ambidextrous Cam Style Charging Handle" issued to Kincel on Dec. 25, 2012, and U.S. Pat. No. 8,356,537, entitled "Ambidextrous Charging Handle" issued to Kincel on Jan. 22, 2013, which are incorporated herein by reference.

These systems are improvements over prior ambidextrous charging handles because metal fatigue and torque are reduced. However, these systems utilize protruding elements on the crossbar of the charging handle, as well as internal lever systems that are subject to stress and potential breakage after repeat usage. Previous designs that require force to be applied to two surfaces would often result in the user's hand being pinched. Moreover, repeated application of force causes the pivot shaft/roll pin to fail.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

SUMMARY OF THE INVENTION

Figure 1A:
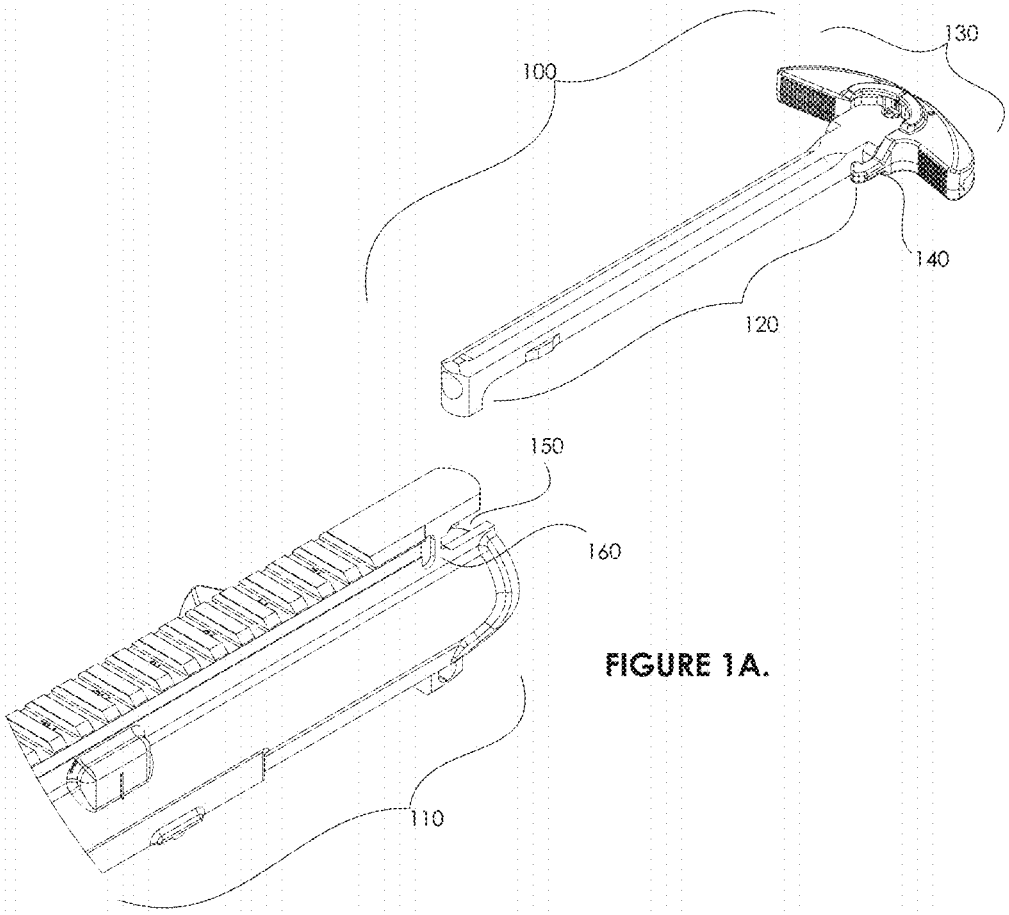
FIG. 1A is an exploded view of a fully assembled charging handle with cog and an upper receiver of an exemplary firearm.

In one aspect of the present invention, a firearm comprising an upper receiver and a charging handle is disclosed. A charging handle has a handle assembly with two handles and a main body. The first handle includes a latch parallel to the main body. When the latch interfaces with the upper receiver, the charging handle is in a first "locked" position. The handle assembly also includes a plunger interfacing with the first handle and the second handle near the main body, and a spring bar spanning the first handle, the plunger, and the second handle. When force is applied to either handle, tension from the spring bar is applied equally across the first handle and the second handle, and the plunger is pushed into the main body, moving the latch away from the upper receiver into a second "unlocked" position.

In another aspect of the present invention, a charging handle with cog and spring bar is disclosed. A handle assembly has two handles and a main body. The first handle includes a latch parallel to the main body. When the latch interfaces with the upper receiver, the charging handle is in a first "locked" position. The handle assembly also includes a plunger interfacing with the first handle and the second handle near the main body, and a spring bar spanning the first handle, the plunger, and the second handle. When force is applied to either handle, tension from the spring bar is applied equally across the first handle and the second handle, and the plunger is pushed into the main body, moving the latch away from the upper receiver into a second "unlocked" position.

In yet another aspect of the present invention, a firearm comprising an upper receiver and a charging handle is disclosed. A charging handle has a handle assembly with two handles and a main body. The first handle includes a latch parallel to the main body. When the latch interfaces with the upper receiver, the charging handle is in a first "locked" position. The handle assembly also includes a plunger interfacing with the first handle and the second handle near the main body, and a coil spring inside the plunger. When force is applied to either handle, tension from the coil spring pushes the plunger into the main body, and energy is transferred to the handles, moving the latch away from the upper receiver into a second "unlocked" position.

In yet another aspect of the present invention, a charging handle with cog and spring bar is disclosed. A handle assembly has two handles and a main body. The first handle includes a latch parallel to the main body. When the latch interfaces with the upper receiver, the charging handle is in a first "locked" position. The handle assembly also includes a plunger interfacing with the first handle and the second handle near the main body, and a coil spring inside the plunger. When force is applied to either handle, tension from the coil spring pushes the plunger into the main body, and energy is transferred to the handles, moving the latch away from the upper receiver into a second "unlocked" position.

DETAILED DESCRIPTION OF THE INVENTION

With reference to the drawings and in operation, the present invention overcomes at least some of the disadvantages of known charging handles. The present invention allows the user to apply force with one hand to a single surface (i.e., the lever) rather than two or more surfaces.

Referring now to FIG. 1A, an exploded view of a fully assembled charging handle 100 and a cut-away of an upper receiver 110 of an exemplary firearm is shown. Main body 120 is T-shaped and coupled to handle assembly 130. Handle assembly 130 includes a latch 140. When coupled to the upper receiver 110, main body 120 of charging handle 100 slides into an opening 150. Latch 140 interfaces with upper receiver 110 at a latch aperture 160. When latch 140 is engaged in latch aperture 160, the charging handle 100 is in the "locked" position and remains stationary.

Figure 1B:
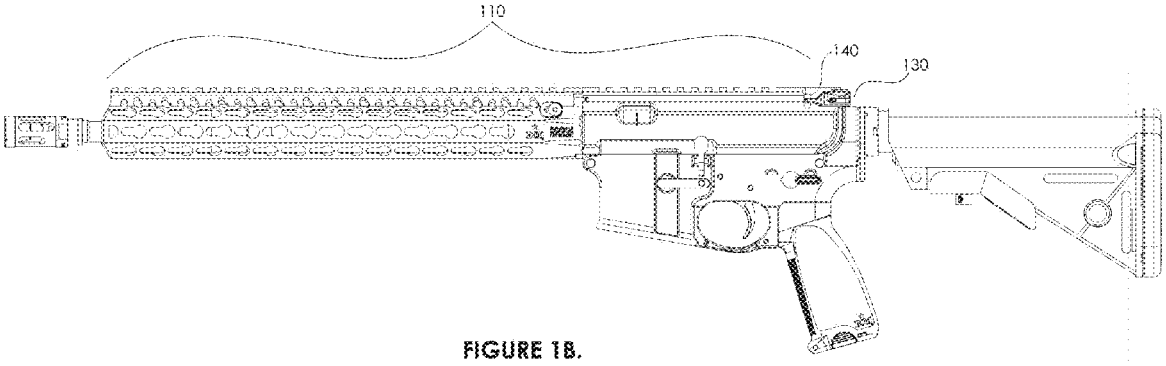
FIG. 1B is a side view of a fully assembled charging handle with cog on an exemplary firearm.
Figure 1C:
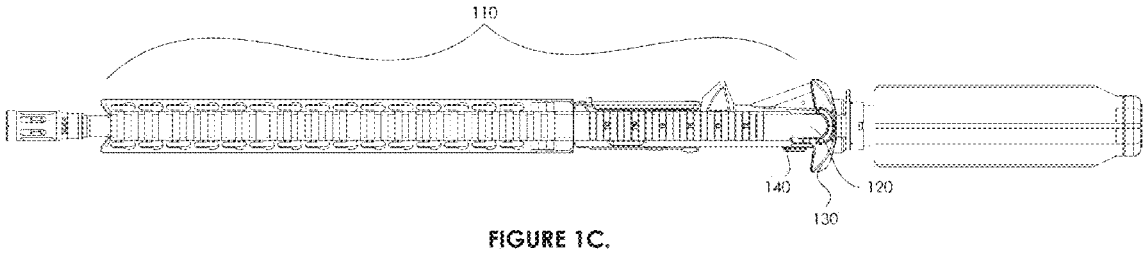
FIG. 1C is a top view of a fully assembled charging handle with cog on an exemplary firearm.

Referring now to FIGS. 1B and 1C, views of a fully assembled charging handle with cog on an exemplary firearm are shown, wherein the charging handle assembly is shown in a locked position. Charging handle 100 is positioned partially within upper receiver 110 with the portion of charging handle 100 containing handle assembly 130 exposed for operator manipulation.

Figure 2A:
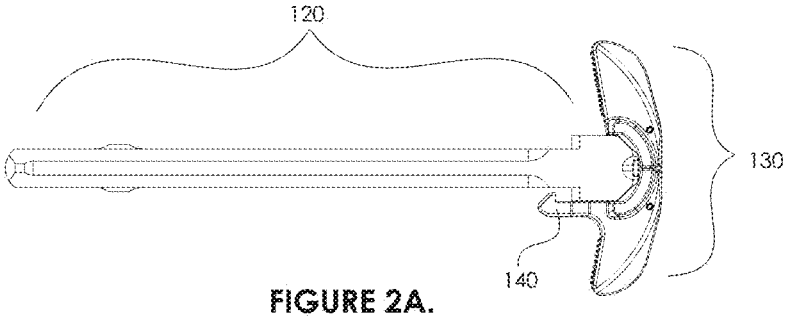
FIG. 2A is a top plan view of a charging handle with cog.
Figure 2B:
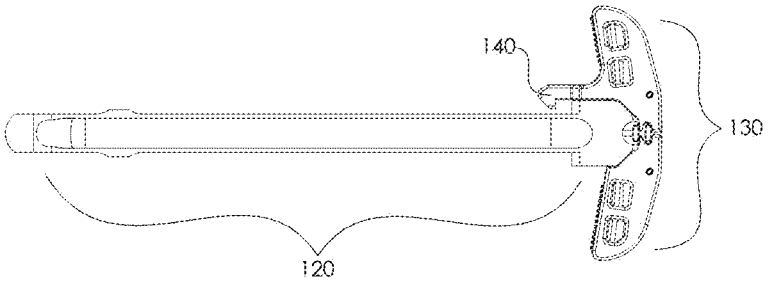
FIG. 2B is a bottom plan view of a charging handle with cog.

Referring now to FIGS. 2A-2B, top plan and bottom plan views of a fully assembled charging handle (independent of the firearm) are shown.

Cog and Spring Bar

Figure 3:
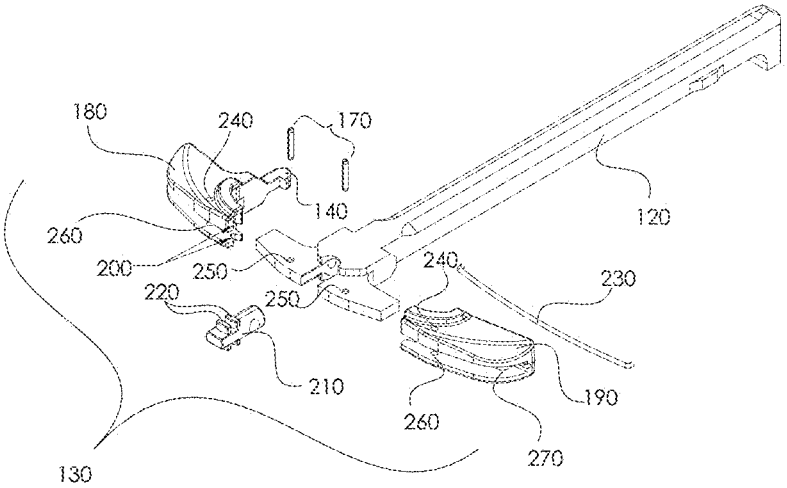
FIG. 3 is an exploded perspective view of a charging handle with cog and spring bar.

Referring now to FIG. 3, an exploded view of a charging handle with cog and spring bar is illustrated. Main body 120 is T-shaped and coupled to handle assembly 130 with pins 170. Handle assembly 130 consists of a first handle 180 and a second handle 190. First handle 180 and second handle 190 each comprise two connected plates (upper and lower) with a cavity in the center. First handle 180 includes latch 140. First handle 180 includes an external edge furthest away from main body 120 and an internal edge closest to main body 120. First handle 180 may further include gear teeth 200 on the internal edge closest to main body 120. Second handle 190 includes an external edge furthest away from main body 120, and an internal edge closest to main body 120.

First handle 180 and second handle 190 may be injection-molded from any high-strength, temperature-resistant material. This construction would help prevent wear on the parts and render the charging handle lighter.

Plunger 210 connects to the T-shaped handle of main body 120. Plunger 210 includes one or more cogs 220. Spring bar 230 is also shown. Plunger 210 and spring bar 230 are described in more detail below.

As can be seen from FIG. 3, pins 170 pass through apertures 240 in the first plates of first handle 180 and second handle 190, apertures 250 in main body 120, and apertures 260 in the second plates of first handle 180 and second handle 190, to secure the handle assembly 130 to main body 120.

Referring again to FIG. 3, first handle 180 and second handle 190 may contain a number of apertures, one of which is labeled 270, in the second plate, which serve a dual purpose of making the charging handle lighter by removing mass from the assembly, and of allowing dirt or debris to pass through instead of collecting in the handle assembly.

Figure 4:
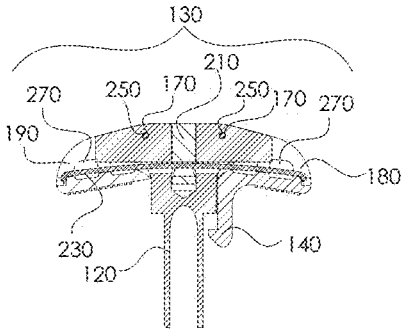
FIG. 4 is a top cross-sectional view of a partial charging handle with cog and spring bar.

Referring now to FIG. 4, a top cross-sectional view of a partial charging handle with cog and spring bar is illustrated. Plunger 210 is shown interfacing on a first side with the internal edge of first handle 180, and on a second side the internal edge of second handle 190. Cogs 220 (not shown) interface with the gear teeth 200 (not shown) of first handle 180, such that the cogs 220 and the gear teeth 200 interact in a rack-and-pinion manner.

Spring bar 230 connects at a first end to first handle 180, spans the T-handle of main body 120 between cogs 220 of plunger 210, and connects at a second end to second handle 190.

Thus, the traditional lever system in the charging handle has been replaced in the present invention by a handle and cog system that eliminates the necessity of interlocking or interfacing latches.

Figure 5A:
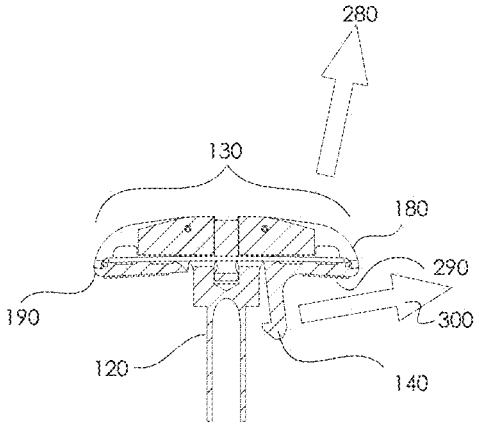
FIGS. 5A and 5B are cross-sectional views of a partial charging handle with cog and spring bar illustrating operation of the charging handle assembly.
Figure 5B:
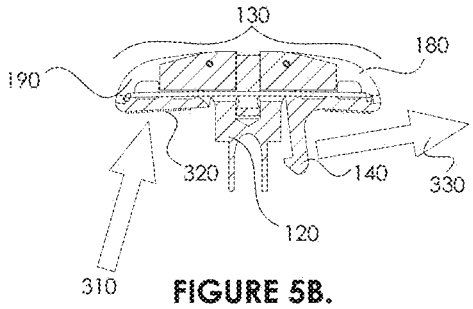

Referring now to FIGS. 5A and 5B, cross-sectional views of a partial charging handle with cog and spring bar illustrating operation of the charging handle assembly are shown. As seen in FIG. 5A, pressure may be applied by the user (with one finger, for example) in a rearward direction 280 to finger surface 290 of first handle 180. This motion causes the gear teeth 200 of first handle 180 to push plunger 210 into main body 120, which in turn moves latch 140 in an outward direction 300, which ultimately disengages the firearm receiver into an "unlocked" position. Spring bar 230 applies equal tension on both first handle 180 and second handle 190, as well as the plunger 210 to prevent rattling during operation.

Similarly, as shown in FIG. 5B, pressure may be applied by the user (with one finger, for example) in a rearward direction 310 to finger surface 320 of second handle 190. This motion causes the movement of latch 140 in an outward direction 330, which disengages the latch from the firearm receiver into an "unlocked" position. This motion causes the gear teeth 200 of first handle 180 to push plunger 210 into main body 120, which in turn moves latch 140 in an outward direction, which ultimately disengages the firearm receiver into an "unlocked" position. Spring bar 230 applies equal tension on both first handle 180 and second handle 190 as well as the plunger 210, to prevent rattling during operation.

FIGS. 5A and 5B illustrate that a user may use a single finger to disengage latch 140 by applying pressure either to first handle 180 or to second handle 190. Alternatively, the user may use more than one finger to disengage latch 140 by applying pressure to both first handle 180 and second handle 190 simultaneously. No pressure is applied, either directly or by transfer, to main body 120.

Cog and Coil Spring

Figure 6:
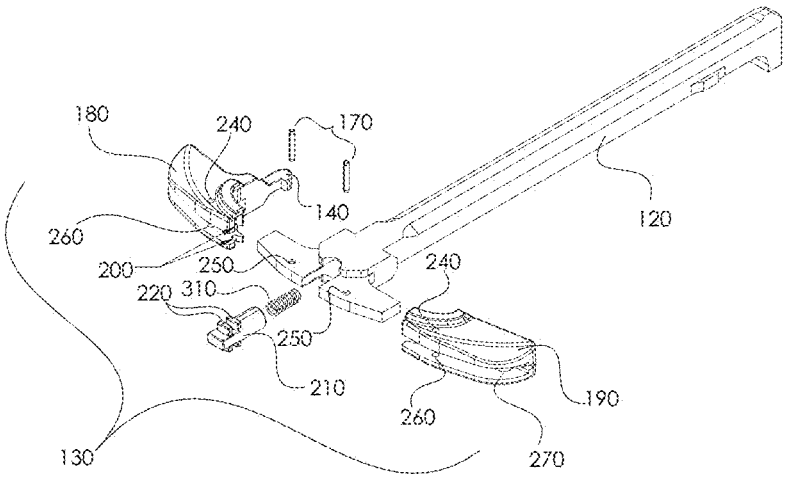
FIG. 6 is an exploded perspective view of a charging handle with cog and coil spring.

Referring now to FIG. 6, an exploded view of a charging handle with cog and coil spring is illustrated. Main body 120 is T-shaped and coupled to handle assembly 130 with pins 170. Handle assembly 130 consists of a first handle 180 and a second handle 190. First handle 180 and second handle 190 each comprise two connected plates (upper and lower) with a cavity in the center. First handle 180 includes latch 140. First handle 180 includes an external edge furthest away from main body 120 and an internal edge closest to main body 120. First handle 180 may further include gear teeth 200 on the internal edge closest to main body 120. Second handle 190 includes an external edge furthest away from main body 120, and an internal edge closest to main body 120.

First handle 180 and second handle 190 may be injection-molded from any high-strength, temperature-resistant material. This construction would help prevent wear on the parts and render the charging handle lighter.

Plunger 210 connects to the T-shaped handle of main body 120. Plunger 210 includes one or more cogs 220. Coil spring 310 is also shown. Plunger 210 and coil spring 310 are described in more detail below.

As can be seen from FIG. 6, pins 170 pass through apertures 240 in the first plates of first handle 180 and second handle 190, apertures 250 in main body 120, and apertures 260 in the second plates of first handle 180 and second handle 190, to secure the handle assembly 130 to main body 120.

Referring again to FIG. 6, first handle 180 and second handle 190 may contain a number of apertures, one of which is labeled 270, in the second plate, which serve a dual purpose of making the charging handle lighter by removing mass from the assembly, and of allowing dirt or debris to pass through instead of collecting in the handle assembly.

Figure 7:
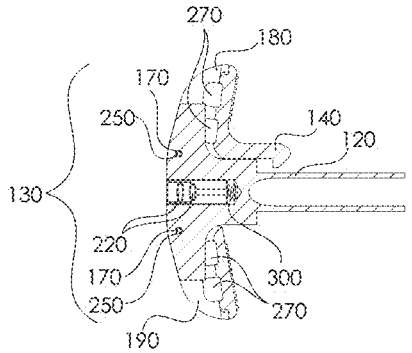
FIG. 7 is a top cross-sectional view of a partial charging handle with cog and coil spring.
Figure 8:
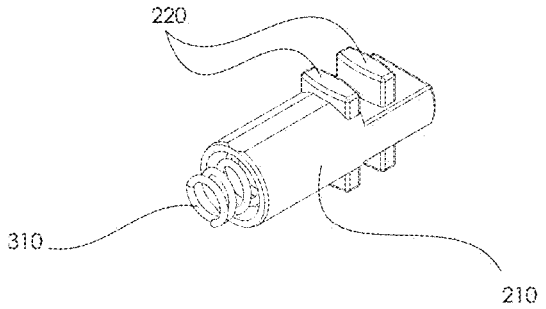
FIG. 8 is a perspective view of a plunger with cogs engaged with a coil spring.

Referring now to FIG. 7, a top cross-sectional view of a partial charging handle with cog and coil spring is illustrated. Plunger 210 is shown interfacing on a first side with the internal edge of first handle 180, and on a second side the internal edge of second handle 190. Cogs 220 (not shown) interface with the gear teeth 200 (not shown) of first handle 180, such that the cogs 220 and the gear teeth 200 interact in a rack-and-pinion manner. Coil spring 310 fits inside plunger 210, as shown in FIG. 8.

Thus, the traditional lever system in the charging handle has been replaced in the present invention by a handle and cog system that eliminates the necessity of interlocking or interfacing latches.

Figure 9A:
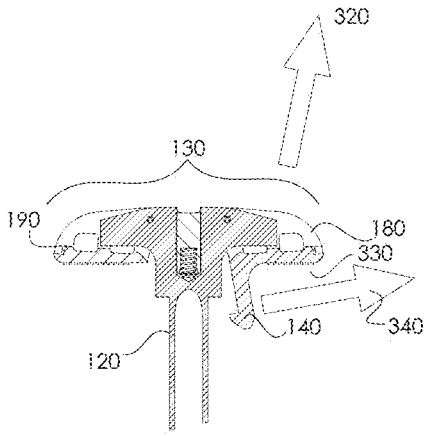
FIGS. 9A and 9B are cross-sectional views of a partial charging handle with cog and coil spring illustrating operation of the charging handle assembly.
Figure 9B:
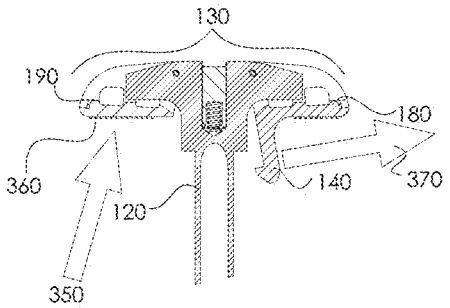

Referring now to FIGS. 9A and 9B, cross-sectional views of a partial charging handle with cog and coil spring illustrating operation of the charging handle assembly are shown. As seen in FIG. 9A, pressure may be applied by the user (with one finger, for example) in a rearward direction 320 to finger surface 330 of first handle 180. This motion causes the gear teeth 200 of first handle 180 to push plunger 210 into main body 120, which in turn moves latch 140 in an outward direction 340, which ultimately disengages the firearm receiver into an "unlocked" position. Coil spring 310 applies tension to the plunger 210 only, which in turn transfers the tension through the gear teeth 200, which in turn transfers the tension to first handle 180 and second handle 190.

Similarly, as shown in FIG. 9B, pressure may be applied by the user (with one finger, for example) in a rearward direction 350 to finger surface 360 of second handle 190. This motion causes the movement of latch 140 in an outward direction 370, which disengages the latch from the firearm receiver into an "unlocked" position. This motion causes the gear teeth 200 of first handle 180 to push plunger 210 into main body 120, which in turn moves latch 140 in an outward direction, which ultimately disengages the firearm receiver into an "unlocked" position. Coil spring 310 applies tension to the plunger 210 only, which in turn transfers the tension through the gear teeth 200, which in turn transfers the tension to first handle 180 and second handle 190.

FIGS. 9A and 9B illustrate that a user may use a single finger to disengage latch 140 by applying pressure either to first handle 180 or to second handle 190. Alternatively, the user may use more than one finger to disengage latch 140 by applying pressure to both first handle 180 and second handle 190 simultaneously. No pressure is applied, either directly or by transfer, to main body 120.

Obviously, many modifications and variations of the present invention are possible in light of the above teachings. In addition, the reference numerals in the claims are merely for convenience and are not to be read in any way as limiting.

What is claimed is:

1. A firearm comprising:

an upper receiver; and a charging handle coupled to the upper receiver, the charging handle including:

a T-shaped main body, wherein a top end of the main body includes two arms, a first handle and a second handle and being rotationally coupled to the main body, wherein the first handle and the second handle cover the two arms of the main body, the first handle being rotationally coupled around a first arm of the main body about a first pivot point and having a first edge nearest the main body containing a plurality of gear teeth, a second edge farthest from the main body, and a latch extending from the first handle parallel to the main body for interfacing with the upper receiver in a first position, the second handle being rotationally coupled around a second arm of the main body about a second pivot point and having a first edge nearest the main body and a second edge farthest from the main body, and a plunger interfacing with the first edge of the first handle and the first edge of the second handle, wherein the plunger contains a plurality of cogs that interface with the plurality of gear teeth of the first edge of the first handle, and a coil spring inside the plunger, such that when force is applied to the first or second handle, tension from the coil spring is applied to the plunger and the plunger is pushed into the main body, wherein the latch is moved into a second position.

2. The firearm of claim 1, wherein the charging handle remains stationary on the firearm when the latch is in the first position.

3. The firearm of claim 1, wherein the charging handle is movable about the firearm when the latch is in the second position.

4. The firearm of claim 1, wherein the handle assembly includes a plurality of apertures to prevent debris from collecting on the handle assembly.

5. The firearm of claim 1, wherein the main body is coupled to the handle assembly by one or more pins.

6. A charging handle for a firearm, the charging handle comprising:

a T-shaped main body, wherein a top end of the main body includes two arms; and a handle assembly including:

a first handle and a second handle and being rotationally coupled to the main body, wherein the first handle and the second handle cover the two arms of the main body, the first handle being rotationally coupled around a first arm of the main body about a first pivot point and having a first edge nearest the main body, a second edge farthest from the main body, and a latch extending from the first handle parallel to the main body for interfacing with the upper receiver in a first position, the second handle being rotationally coupled around a second arm of the main body about a second pivot point and having a first edge nearest the main body and a second edge farthest from the main body, and a plunger interfacing with the first edge of the first handle and the first edge of the second handle, wherein the plunger contains a plurality of cogs that interface with a plurality of gear teeth of the first edge of the first handle, and a coil spring inside the plunger, such that when force is applied to the first or second handle, tension from the coil spring is applied to the plunger and the plunger is pushed into the main body, wherein the latch is moved into a second position.

7. The charging handle of claim 6, wherein the charging handle remains stationary on the firearm when the latch is in the first position.

8. The charging handle of claim 6, wherein the charging handle is movable about the firearm when the latch is in the second position.

9. The charging handle of claim 6, wherein the handle assembly includes a plurality of apertures to prevent debris from collecting on the handle assembly.

10. The charging handle of claim 6, wherein the main body is coupled to the handle assembly by one or more pins.

* * * * *